US005086284A

United States Patent [19]

Mouissie

[11] Patent Number: 5,086,284

[45] Date of Patent: Feb. 4, 1992

[54] CONNECTOR HAVING A SWITCHING DEVICE

[75] Inventor: Bob Mouissie, Berlicum, Netherlands

[73] Assignee: E. I. Du Pont de Nemours and Company, Wilmington, Del.

[21] Appl. No.: 461,821

[22] Filed: Jan. 8, 1990

[30] Foreign Application Priority Data

Jan. 16, 1989 [NL] Netherlands ..... 8900092

[51] Int. Cl.[5] ..... H01H 36/00

[52] U.S. Cl. ..... 335/205; 200/51 R; 200/51.09

[58] Field of Search ..... 335/205; 200/51 R, 51.09, 200/51.1, 51.11, 51.12

[56] References Cited

U.S. PATENT DOCUMENTS 3,496,500 2/1970 Romary ..... 335/205
4,792,651 12/1988 Whiting ..... 335/205

FOREIGN PATENT DOCUMENTS 19602496 6/1970 Fed. Rep. of Germany .
1590479 7/1970 Fed. Rep. of Germany .
1802457 4/1974 Fed. Rep. of Germany .
2602079 1/1988 France .
1146983 3/1969 United Kingdom ..... 335/205

*Primary Examiner*—Harold Broome

[57] ABSTRACT

A connector comprising a carrier body with at least two contact elements and a magnetically actuatable switching device. The switching device is arranged to electrically connect or disconnect the two contact elements when the connector mates with or disconnects from another connector. Control means activate the switching device. The control means includes a movably disposed tracer finger. In a preferred embodiment, the switching device includes a reed relay which is activated by a permanent magnet.

12 Claims, 1 Drawing Sheet

CONNECTOR HAVING A SWITCHING DEVICE

BACKGROUND OF THE INVENTION

The invention relates to a connector and more particularly to a connector having a switching device with control means for actuating the switching device when the connector is connected or disconnected from another connector.

Connectors of this type are in practice generally used for safety purposes. When the connector is the disconnected state wherein its contact elements are not contacted by another connector, it may be necessary to connect two or more of these contact elements electrically with each other in order to prevent electrical or electronic circuits connected to the contact elements from being actuated by interference signals.

An example of where such connectors may be used is with the circuits controlling air bags in automobiles. An air bag typically is placed, in or around, the steering wheel. In a head-on collision, the bag inflates quickly to protect the driver from internal and other injuries that might be caused by impact with the steering wheel and the windshield. The inflation of the air bag is controlled by an electronic circuit which is connected to the ignition elements of the air bag by means of a connector. In order to prevent the air bag from being ignited accidentally when his connector is disconnected, it is necessary to connect certain of its contact elements electrically with each other as soon as the connector in question is disconnected.

Another use for such connectors is in measuring devices found in vehicles. It is necessary sometimes to short-circuit electrical measuring circuits relative to each other when they are not being excited electrically.

Connectors used for this purpose typically have one or more mechanical switches, such as shown in German Patent Specification 1,802,457. A contact bridge situated between several pairs of adjacent contact elements short-circuits the appropriate contact elements relative to each other when the connector is disconnected. The short-circuit is eliminated when the connector is mated to another connector.

A major disadvantage of this type of connector is that the contact elements to be connected electrically to the switches must be arranged adjacent to each other. This leads to an undesirable restriction in wiring freedom in the connector and also in the mating connector. If more than two contact elements have to be connected to each other, further extensive contact bridges or electrical switch contacts are necessary. This leads to mechanically complex and consequently fault-prone constructions.

SUMMARY OF THE INVENTION

The object of the present invention is to produce a connector with a switching device with which contact elements positioned in any desired way can be electrically connected to each other, and in which great freedom in the layout of the switching device and the control means cooperating therewith is possible.

This is achieved according to the present invention by providing a switching device which has at least one magnetically actuable switch with a permanent magnet and by providing a control means with spring means to move the permanent magnet and the switch into a first position relative to each other such that the latter takes up a first switch position. The switching device also has at least one movably disposed tracer finger for moving the permanent magnet and the switch into a second position relative to each other in such a way that the latter takes up a second switch position.

The use of a switch which can be actuated by a permanent magnet achieves a mechanically relatively simple structure and provides great freedom in the choice of the position of such a switch and the control means working therewith. This means that the switching device can essentially be accommodated in conventional connectors without major adaptation of their design or changing the selected occupation of the contact elements. This is advantageous particularly in the case of connectors with a standardized contact element occupation and fixed dimensions.

Connectors used in vehicles, vessels and aircraft are generally subject to greatly fluctuating climatic conditions and to shocks and impacts. When used for such safety purposes as described above, it is absolutely essential that switching device produce a reliable connection between contact elements. Another embodiment of the present invention, therefor, provides that the at least one switch is formed by a reed relay.

Reed relays, in which two or more contact tongues are set up in a gastight housing, can produce very reliable connections. Reed relays are also compact in construction, which makes them easy to accommodate in existing connector designs.

A preferred embodiment of the connector according to the present invention provides that the reed relay is elongated in shape and the permanent magnet is in the form of a ring. The reed relay is disposed in the central opening of the magnet ring. Depending on the relative positions of the permanent magnet and the reed relay, the contact(s) thereof is (are) closed or opened.

Another advantageous embodiment of the connector of the present invention in terms of design provides that the switch is fixed. The permanent magnet is disposed so that it is movably supported relative to the carrier body.

In order to bring about automatic activation of the switching device through mating or disconnecting the connector from another connector, yet another embodiment of the connector of the present invention provides that the at least one tracer finger be disposed movably supported in the carrier body in such a way that one end thereof is accessible from the contact ends of the contact elements, and another end is designed for displacement of the permanent magnet. The tracer finger is preferably designed so that it is movable in the direction parallel to the plug-in direction of the connector. As already mentioned, using a magnetically actuated switch, for example in the form of a reed relay, provides a great measure of freedom in positioning the switch and the control means engaging therewith.

A design variant of the connector according to the present invention provides that the at least one switch is arranged in such a way that, in order to take it to the first and second switch positions, the permanent magnet must be moved in a direction at right angles to the direction of movement of the tracer finger. Disposed at the other end of the tracer finger is a translation mechanism which is connected to the permanent magnet. One end of the translation mechanism is rigidly supported relative to the carrier body, while another end engages the tracer finger. The spring means exerts a force on the tracer in the direction away from the carrier body to take the permanent magnet into the first position. By exerting a force on the tracer finger in the direction towards the carrier body, the permanent magnet can be displaced via the translation mechanism to the second position.

Another embodiment based on this variant provides that the translation mechanism is a link lever system, while the spring means include a compression spring acting on the tracer finger. Yet another embodiment provides that the translation mechanism is a leaf spring whose central section is connected to the permanent magnet. Under the influence of the spring action of this leaf spring, a force is exerted on the tracer finger in the direction away from the carrier body, and through exertion of a force on the tracer finger in the direction towards the carrier body the leaf spring undergoes a bending which displaces the permanent magnet.

Another design variant of the connector according to the invention provides that the one switch is arranged in such a way that for taking it into the first or second switch position the permanent magnet must be displaced in the direction of movement of the tracer finger and is rigidly connected thereto. The spring means include a compression spring which exerts a force on the tracer finger in the direction away from the carrier body to take the permanent magnet into the first position, and through exertion of a force on the tracer finger in the direction towards the carrier body the permanent magnet can be moved against the spring force to the second position.

The tracer finger can according to the invention be designed as a movable pin, one end of which can project outside the connector, for example at the contact side thereof. The switching device can be arranged in such a way that when the connector is disconnected the switch is closed, and when it is connected to another connector the tracer finger is moved inwards in the connector, which results in the switch being opened. Under the influence of the spring force acting on the tracer finger, the switch is then closed again when the connector is disconnected.

The moment of opening or closing of the switch can be determined accurately by a suitable selection of the length of the part of the tracer finger projecting outside the connector. This means that known switch functions such as make-before-break or break-before-make can be acheived. It goes without saying that the switching device can also be dimensioned in such a way that when the connector is disconnected the switch is opened and on connection to a further connector is closed. The tracer finger can according to the invention be designed, for example, as a dish-shaped element, for mating with a boss or pin on the further connector.

By using connectors with a carrier body of plastic, an advantageous design can be achieved according to the invention in that the tracer finger is connected to the carrier body by means of a hinged bar. The carrier body, bar and tracer finger can be made in one piece from plastic by an injection moulding process. A reduction in the number of loose parts is achieved in this way. Yet a further reduction in the number of parts can be achieved through the bar being connected in a spring-loaded manner to the carrier element for execution of the necessary spring force on the tracer finger. This means that separate spring means are unnecessary.

The invention will be explained below in greater detail with reference to examples of embodiments shown in the drawings.

DETAILED DESCRIPTION OF THE EMBODIMENTS

Figure 1:
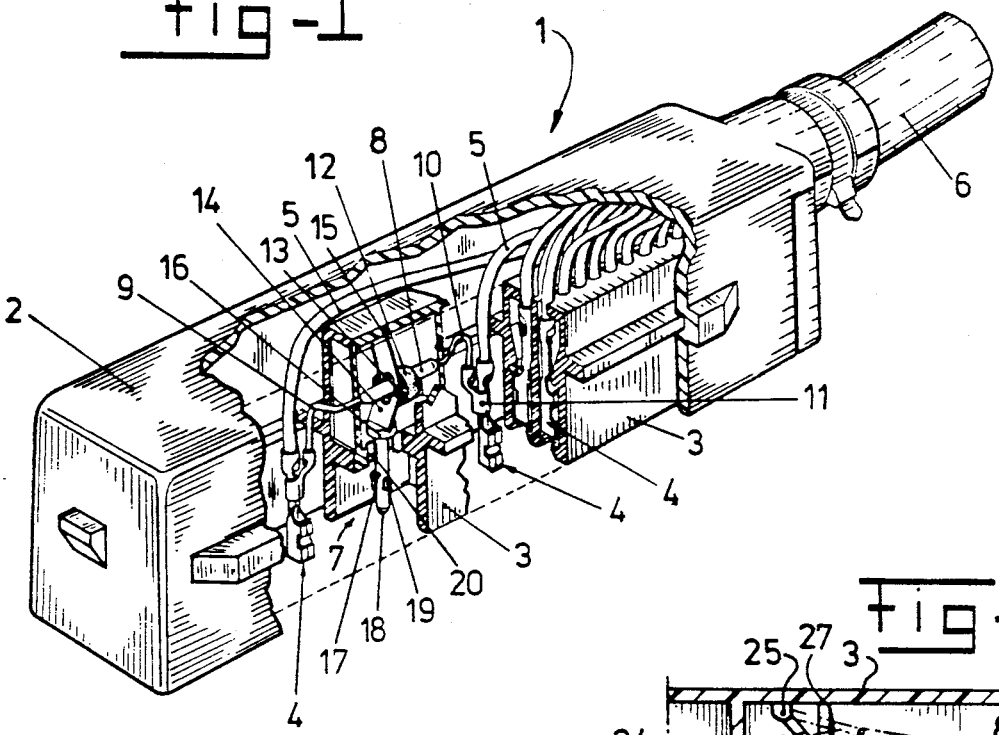
FIG. 1 shows schematically in perspective a cut-away connector with a switching device according to the invention, which is partially shown in cross section.

FIG. 1 shows partially cut-away, in perspective, an embodiment of a connector 1 which generally resembles the type of connector used in the automobile industry. The housing 2 comprises a carrier body 3 of electrically insulating material containing a plurality of contact elements 4 of electrically conducting material. Although the contact ends of the contact elements 4 are designed as socket connectors, they can also be plug pins. Wires 5 of a connection cable 6 are connected to the connection ends of the contact elements 4.

In the embodiment illustrated, the carrier body 3 contains a switching device 7 according to the invention, which for the sake of clarity is shown partially in cross section. In this embodiment of the switching device, the switch is formed by an elongated reed relay 8, with a gastight housing which extends virtually parallel to the long sides of the carrier body 3. The connection wires 9, 10 of the reed relay 8 are each connected by means of terminals 11 to another contact element 4 of the connector 1. It goes without saying that the connection wires 9, 10 can also be connected directly to the connection ends of the contact elements 4.

A permanent magnet 12 in the form of a ring core with a central opening for the reed relay 8 is disposed movably in the lengthwise direction of the reed relay. By means of L-shaped bosses 13 the permanent magnet 12 is connected to a leaf spring 14, provided with an opening for the reed relay 8. The leaf spring 14 lies with one end in a groove 15 of the carrier body and with the other end in a groove in the head 16 of a pin-shaped tracer finger 17, which can be made of, for example, plastic or metal.

The tracer finger 17 is supported in the carrier body 3 in such a way that it is displaceable in the lengthwise direction through a guide channel. Bosses 19 are formed opposite each other some distance away from the end 18 of the tracer finger 17. These bosses 19 correspond to openings 20 in the carrier body 3 of the connector, said openings being connected to the guide channel. The tracer finger 17 can in this way be placed with its end 18 in its guide channel in the carrier body 3, in which case the bosses 19 fall into the openings 20. When the tracer finger 17 is in position, giving it a quarter turn can take the groove in the head 16 parallel to the groove 15, for the insertion of the leaf spring 14 therein.

When fitted, the tracer finger 17 is secured against turning by the leaf spring 14, and the bosses 19 act as stops to limit the inward movement of the tracer finger 17. The outward movement of the tracer finger 17 is limited by the head 16 thereof. Making the end 18 of the tracer finger 17 project outwards over a particular distance past the contact ends of the contact element 4 ensures that the reed relay 8 assumes its other switch position before the contact elements 4 come into contact with the corresponding contact elements of another connector. Of course, the length of the tracer finger 17 can also be selected in such a way that the contact elements are first contacted and the reed relay 8 only then takes up its switch position.

The leaf spring 14 is slightly pre-bent, in such a way that when the connector is disconnected an outward-directed force acts on the tracer finger 17, in other words, a force in the direction away from the carrier body 3. Through exertion of an inward-directed force on the tracer finger 17, in other words, in the direction towards the carrier body 3, the leaf spring 14 is bent further, and the permanent magnet 12 is moved in the direction towards the connection cable 6. In the position shown the permanent magnet 12 is virtually in the center of the reed relay 8, in which the switching contacts thereof are in contact with each other.

Figure 2:
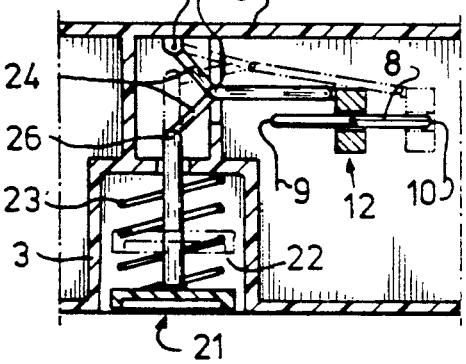
FIGS. 2 and 3 show schematic cross-sectional views of other embodiments of the switching device according to the invention.

FIG. 2 shows schematically a sectional view of another embodiment of the switching device according to the invention, in which, as in FIG. 1, is the direction of movement of the permanent magnet 12 is directed at right angles to that of the tracer finger 21, which in this embodiment is dish-shaped and moves in a guide channel 22 of the carrier body 3. A compression spring 23 acts on the tracer finger 21 in the guide channel 22.

Instead of a leaf spring 14 such as that shown in FIG. 1, the translation of the direction of movement of the tracer finger in the embodiment of FIG. 2 is achieved by means of a link lever system 24. One end 25 of this is hingedly supported by the carrier body 3 and another end 26 is hingedly connected to the tracer finger 21. The permanent magnet 12 is fixed to the link point 27 of the link lever system 24. In this embodiment also a reed relay 8 is used as the switch. This reed relay 8 is connected to the carrier body 3 so that it is rigidly supported.

The operation is now such that in the position shown, under the influence of the compression spring 23 an outward-directed force is exerted on the tracer finger 21, in such a way that the permanent magnet 12 is virtually in the center of the reed relay 8, in which case the contacts thereof are closed. When the tracer finger 21 is moved further in the channel 22, the link lever system 24 will make a scissor movement, as a result of which the permanent magnet 12 is moved to the right in the plane of the drawing, as shown by the broken lines. In this situation, the inherent spring force of the switch contacts of the reed relay 8 is greater than the magnetic field of the permanent magnet 12 acting thereon, as a result of which the connection is broken. The embodiment shown is particularly suitable for working in conjunction with a projection, for example a boss or pin on the other connector to which the connector according to the invention is to be connected. The displacement of the tracer finger can be limited if necessary with means for limiting the displacement of the permanent magnet (not shown).

Figure 3:
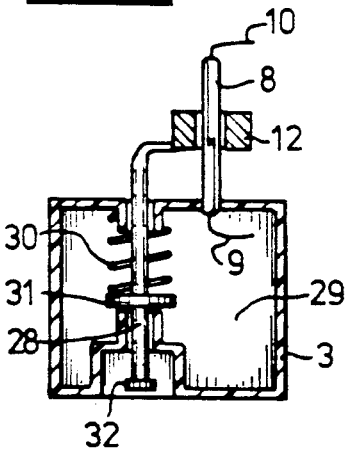

FIG. 3 shows a sectional view of yet another embodiment of the switching device according to the invention, in which the reed relay 8 is arranged parallel to the direction of movement of the tracer finger 28, which is disposed so that it is movably supported in a guide channel 29 of the carrier body 3. In the guide channel 29 a compression spring 30 acts on the tracer finger 28, which for this purpose is provided with a stop 31 which also acts as the limit for the outward stroke of the tracer finger 28, as shown. The permanent magnet 12 is fixed to the tracer finger 28.

In the position shown the permanent magnet 12 is virtually in the center of the reed relay 8, as a result of which the switching contacts thereof are closed. Through the exertion of a force in the direction towards the carrier body 3, the tracer finger, and consequently the permanent magnet 12, is moved against the action of the compression spring 30 upwards in the plane of the drawing, as a result of which the switching contacts of the reed relay 8 open. A stop 32 is formed at the outward-projecting end of the tracer finger 28 to limit the inward stroke thereof.

Figure 4:
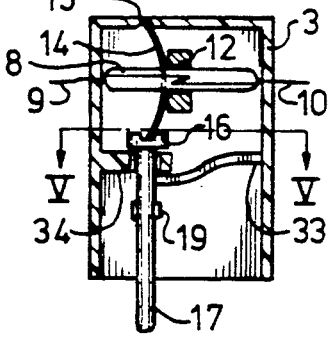
FIG. 4 shows schematically a sectional view of a further embodiment of the switching device shown in FIG. 1.
Figure 5:
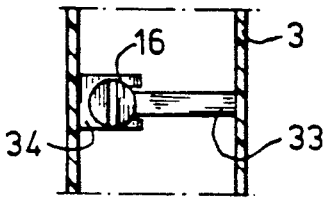
FIG. 5 shows a cross section along the line V—V in FIG. 4.

A design of an embodiment with which the number of loose parts can be reduced is shown schematically in a sectional view in FIG. 4. This embodiment is based on the design according to FIG. 1. The tracer finger 17 is now connected to the carrier body 3 via a bar 33, in such a way that the carrier body 3, the tracer finger 17 and the bar 33 can all be made in one piece. The bar 33 has such appropriate measurements that, not only is there sufficient holding power for the tracer finger 17, displacement thereof is also possible. If necessary, the bar 33 can have a spring action to take the tracer finger into a particular position so that, for example, return springs such as 23, 30 in FIGS. 2 and 3 could be omitted.

To limit the displacement of the tracer finger 17 provision is made for a fork-shaped member 34 projecting from the carrier body 3 at right angles to the lengthwise direction of said tracer finger. This member 34 is positioned in such a way and has such dimensions that the outward displacement of the tracer finger 17 is limited by this member 34 and the head 16, and the inward movement is limited by the member 34 and the bosses 19 of the tracer finger 17. The member 34 can be integral with the carrier body 3.

It will be clear that instead of one switching device, several switching devices if necessary with several tracer fingers can be accommodated in a connector, or several contact elements can be connected to each other by means of one and the same switch. Due to its wide positioning scope, the switching device according to the invention can be used in many types of connector, in which many different embodiments of magnetically actuated switches and their permanent magnets can be used.

I claim:

1. An electrical connector comprising:

a housing of electrically insulating material enclosing a carrier body of electrically insulating material, said carrier body containing a plurality of contact elements of electrically conducting material, one end of each contact element adapted for detachable mating with other contact means at one side of the housing;

at least one magnetically actuable elongated reed relay switch electrically connectible to at least two of said contact elements;

a permanent magnet disposed in said carrier body in the form of a ring with a central opening, the reed relay switch being disposed in the central opening of the magnet ring; and a tracer finger supported by said carrier body and being biased by a spring means to move said permanent magnet relative to said reed relay switch during mating or disconnection of said contact elements.

2. A connector according to claim 1 wherein said magnetically actuatable switch is fixed and the permanent magnet is disposed so that it is movably supported relative to the carrier body.

3. A connector according to claim 2 wherein said tracer finger is disposed so that it is movably supported in the carrier body with one end thereof being accessible from the contact ends of the contact elements, and another end being adapted for displacement of the permanent magnet.

4. A connector according to claim 3 wherein the tracer finger is arranged so that it is movable in the direction parallel to the mating direction of the connector.

5. A connector according to claim 3 wherein the magnetically actuable reed relay switch is arranged so that in order to move the switch into first and second switch positions, the permanent magnet must be moved in a direction at right angles to the direction of movement of the tracer finger, said tracer finger having disposed at its other end a translation mechanism which is connected to the permanent magnet, one end of the translation mechanism being arranged rigidly supported relative to the carrier body, while the other end of the translation mechanism engages with the tracer finger, said spring means exerting a force on the tracer finger in the direction away from the carrier body to move the permanent magnet into the first switch position, while by exertion of a force on the tracer finger in the direction towards the carrier body the permanent magnet can be displaced via the translation mechanism to the second switch position.

6. A connector according to claim 5 wherein the translation mechanism comprises a link lever system in which the spring means are a compression spring acting on the tracer finger.

7. A connector according to claim 5 wherein the translation mechanism comprises a leaf spring having a central section which is connected to the permanent magnet, said leaf spring exerting a spring action force on the tracer finger in the direction away from the carrier body, whereby exertion of a force on the tracer finger in the direction towards the carrier body the leaf spring undergoes a bending which displaces the permanent magnet.

8. A connector according to claim 3 wherein said magnetically actuable need relay switch is arranged so that in order to move it into first and second switch positions the permanent magnet must be moved in the direction of movement of the tracer finger and is rigidly connected thereto, said spring means including a compression spring which exerts a force on the tracer finger in the direction away from the carrier body to take the permanent magnet into the first switch position, while exertion of a force on the tracer finger in the direction towards the carrier body enables the permanent magnet to be moved against the spring force to the second position.

9. A connector according to claim 1 wherein the tracer finger is a movably disposed pin.

10. A connector according to one or more of claim 1 wherein the tracer finger is a dish-shaped element which is movable in a channel formed in the carrier body.

11. A connector according to claim 1 wherein the tracer finger is connected to the carrier body by means of a hinged bar, said carrier body, bar and tracer finger all being formed of one piece of injection molded plastic.

12. A connector according to claim 11, wherein the bar is connected in spring-loaded fashion to the carrier body in order to exert the necessary spring force on the tracer finger.

* * * * *

UNITED STATES PATENT AND TRADEMARK OFFICE

CERTIFICATE OF CORRECTION

PATENT NO. : 5,086,284

DATED : February 4, 1992

INVENTOR(S) : Bob Mouissie

It is certified that error appears in the above-identified patent and that said Letters Patent is hereby corrected as shown below:

Column 8, line 11, delete "need" and insert -- reed --.

Signed and Sealed this

Thirteenth Day of April, 1993

*Attest:*

STEPHEN G. KUNIN

*Attesting Officer*

*Acting Commissioner of Patents and Trademarks*